US007013961B2

(12) United States Patent
Song et al.

(10) Patent No.: US 7,013,961 B2
(45) Date of Patent: Mar. 21, 2006

(54) END PLATE FOR HEAT EXCHANGERS, HEAT EXCHANGER HAVING THE SAME, AND MANUFACTURING METHOD THEREOF

(75) Inventors: Chi Oh Song, Suwon-Si (KR); Kang Tae Seo, Suwon-Si (KR); Chang Bong Shin, Suwon-Si (KR)

(73) Assignee: Samsung Electronics Co., Ltd., Gyeonggi-Do (KR)

( * ) Notice: Subject to any disclaimer, the term of this patent is extended or adjusted under 35 U.S.C. 154(b) by 0 days.

(21) Appl. No.: 10/849,243

(22) Filed: May 20, 2004

(65) Prior Publication Data

US 2005/0133209 A1 Jun. 23, 2005

(30) Foreign Application Priority Data

Dec. 19, 2003 (KR) ..... 10-2003-0093707

(51) Int. Cl.
*F28D 1/04* (2006.01)

(52) U.S. Cl. ..... 165/151; 29/890.03

(58) Field of Classification Search ..... 165/151, 165/152; 29/890.03

See application file for complete search history.

(56) References Cited

U.S. PATENT DOCUMENTS 2,728,982 A * 1/1956 Merrill ..... 72/186
4,876,778 A * 10/1989 Hagihara et al. ..... 29/890.046
5,158,134 A * 10/1992 Mongia et al. ..... 165/150
5,174,366 A * 12/1992 Nagakura et al. ..... 165/151
5,507,338 A * 4/1996 Schornhorst et al. ..... 165/153
5,564,495 A * 10/1996 Yoshihashi et al. ..... 165/151
6,050,773 A * 4/2000 Bushnell ..... 415/53.1

FOREIGN PATENT DOCUMENTS

JP 9-145284 A 6/1997

* cited by examiner

*Primary Examiner*—Teresa J. Walberg
(74) *Attorney, Agent, or Firm*—Sughrue Mion, PLLC

(57) ABSTRACT

An end plate for heat exchangers, includes a plurality of bodies and a connecting part. Each of the plurality of bodies has a plurality of holes to allow a refrigerant pipe to pass through the plurality of bodies. The connecting part connects the plurality of bodies to each other, with a recess being provided on the connecting part to allow the connecting part to be easily bent. A manufacturing method includes preparing a plurality of fins arranged to provide two or more parallel rows of fin arrays, preparing an end plate provided on a side of the fin arrays to connect the fin arrays to each other, inserting a refrigerant pipe into the fin arrays and the end plate to provide an assembly including the refrigerant pipe, the fin arrays, and the end plate, and bending the assembly at a predetermined angle around the connecting part of the end plate.

11 Claims, 4 Drawing Sheets

END PLATE FOR HEAT EXCHANGERS, HEAT EXCHANGER HAVING THE SAME, AND MANUFACTURING METHOD THEREOF

CROSS-REFERENCE TO RELATED APPLICATION

This application claims the benefit of Korean Patent Application No. 2003-93707, filed Dec. 19, 2003 in the Korean Intellectual Property Office, the disclosure of which is incorporated herein by reference.

BACKGROUND OF THE INVENTION

1. Field of the Invention

Apparatuses and methods consistent with the present invention relate, in general, to an end plate for heat exchangers, a heat exchanger having the end plate, and a method of manufacturing the heat exchanger and, more particularly, to an end plate for a heat exchanger used in an indoor unit of an air conditioner, which has a connecting part of an improved structure, and to a heat exchanger having the end plate, and a method of manufacturing the heat exchanger.

2. Description of the Related Art

Generally, an indoor unit of an air conditioner includes a cabinet. An air inlet port is provided on each of front and upper surfaces of the cabinet to draw air into the cabinet. A heat exchanger is installed inside the air inlet ports, and serves to evaporate a refrigerant by absorbing heat from the air drawn into the cabinet. A cross-flow fan is installed in the cabinet, and generates a force that causes the air to flow so that the air is drawn into or discharged from the cabinet. An air outlet port is provided on a lower portion of the cabinet to discharge conditioned air from the cabinet.

The heat exchanger includes a plurality of fins arranged in a row to provide a fin array, an end plate provided on a side of the fin array, and a refrigerant pipe to pass through the fin array and the end plate. The heat exchanger used in the indoor unit is bent several times to reduce a volume of the heat exchanger, prior to being installed in the cabinet.

According to a related art, the fins and the end plate are cut and bent at predetermined positions to bend the heat exchanger at a desired angle when manufacturing the heat exchanger. However, the conventional method of manufacturing the heat exchanger has a problem in that the fins and the end plate may be deformed when the fins and the end plate are cut. The conventional method of manufacturing the heat exchanger has another problem in that manufacturing costs and manufacturing period of the heat exchanger are increased, because an additional process to cut the fins and the end plate is required.

SUMMARY OF THE INVENTION

Illustrative, non-limiting embodiments of the present invention overcome the above disadvantages and other disadvantages not described above. Also, the present invention is not required to overcome the disadvantages described above, and an illustrative, non-limiting embodiment of the present invention may not overcome any of the problems described above.

Accordingly, it is an aspect of the present invention to provide an end plate for heat exchangers, which is constructed to be easily bent without an additional cutting process, when bending a heat exchanger.

It is another aspect of the present invention to provide a heat exchanger having the end plate.

It is a further aspect of the present invention to provide a method of manufacturing the heat exchanger.

Additional aspects and/or advantages of the invention will be set forth in part in the description which follows and, in part, will be understood from the description, or may be learned by practice of the invention.

The above and/or other aspects are achieved by an end plate for heat exchangers, including a plurality of bodies and a connecting part to connect the plurality of bodies to each other. Each of the plurality of bodies has a plurality of holes to allow a refrigerant pipe to pass through the plurality of bodies. A recess is provided on the connecting part to allow the connecting part to be easily bent.

In the end plate for heat exchangers, the connecting part may be provided so that a length of the connecting part is two to three times as large as a width of the connecting part, thus the connecting part is easily bent.

In the end plate for heat exchangers, the connecting part may be provided so that the width of the connecting part is two to three times as large as a thickness of the connecting part.

In the end plate for heat exchangers, the connecting part may be provided to be eccentric from a central axis of the end plate toward a bent direction of the connecting part.

In the end plate for heat exchangers, the recess may include first and second recesses which are respectively provided on opposite sides of the connecting part, with a size of the first recess provided in the bent direction of the connecting part being smaller than the second recess opposite to the first recess.

In the end plate for heat exchangers, the end plate may be made of a galvanized steel sheet having a thickness of 0.8 mm±0.08 mm, and the connecting part may have the width of 2 mm±0.2 mm and the length of 4.85 mm±0.5 mm.

The above and/or other aspects are achieved by a heat exchanger, including a plurality of fins arranged to provide two or more parallel rows of fin arrays, an end plate provided on a side of the fin arrays to connect the fin arrays to each other, and a refrigerant pipe to pass through the fin arrays and the end plate. The end plate includes a plurality of bodies each having a plurality of holes to allow the refrigerant pipe to pass through the plurality of bodies, and a connecting part to connect the plurality of bodies to each other, with a recess being provided on the connecting part to allow the connecting part to be easily bent.

In the heat exchanger, the connecting part may be provided so that a length of the connecting part is two to three times as large as a width of the connecting part, thus the connecting part is easily bent.

In the heat exchanger, the connecting part may be provided so that the width of the connecting part is two to three times as large as a thickness of the connecting part.

In the heat exchanger, the connecting part may be provided to be eccentric from a central axis of the end plate toward a bent direction of the connecting part.

In the heat exchanger, the recess may include first and second recesses which are respectively provided on opposite sides of the connecting part, with a size of the first recess provided in the bent direction of the connecting part being smaller than the second recess opposite to the first recess.

In the heat exchanger, the end plate may be made of a galvanized steel sheet having a thickness of 0.8 mm±0.08 mm, and the connecting part may have the width of 2 mm±0.2 mm and the length of 4.85 mm±0.5 mm.

The above and/or other aspects are achieved by a method of manufacturing a heat exchanger, including preparing a plurality of fins arranged to provide two or more parallel rows of fin arrays, preparing an end plate provided on a side of the fin arrays to connect the fin arrays to each other, inserting a refrigerant pipe into the fin arrays and the end plate through the holes of the plurality of bodies to provide an assembly including the refrigerant pipe, the fin arrays, and the end plate, and bending the assembly, including the refrigerant pipe, the fin arrays, and the end plate, at a predetermined angle around the connecting part of the end plate. In this case, the end plate includes a plurality of bodies each having a plurality of holes, and a connecting part to connect the plurality of bodies to each other, with a recess being provided on the connecting part to allow the connecting part to be easily bent.

BRIEF DESCRIPTION OF THE DRAWINGS

These and other aspects and advantages of the invention will become apparent and more readily appreciated from the following description of the exemplary embodiments, taken in conjunction with the accompanying drawings, in which.

DETAILED DESCRIPTION OF ILLUSTRATIVE, NON-LIMITING EMBODIMENTS OF THE INVENTION

Figure 1:
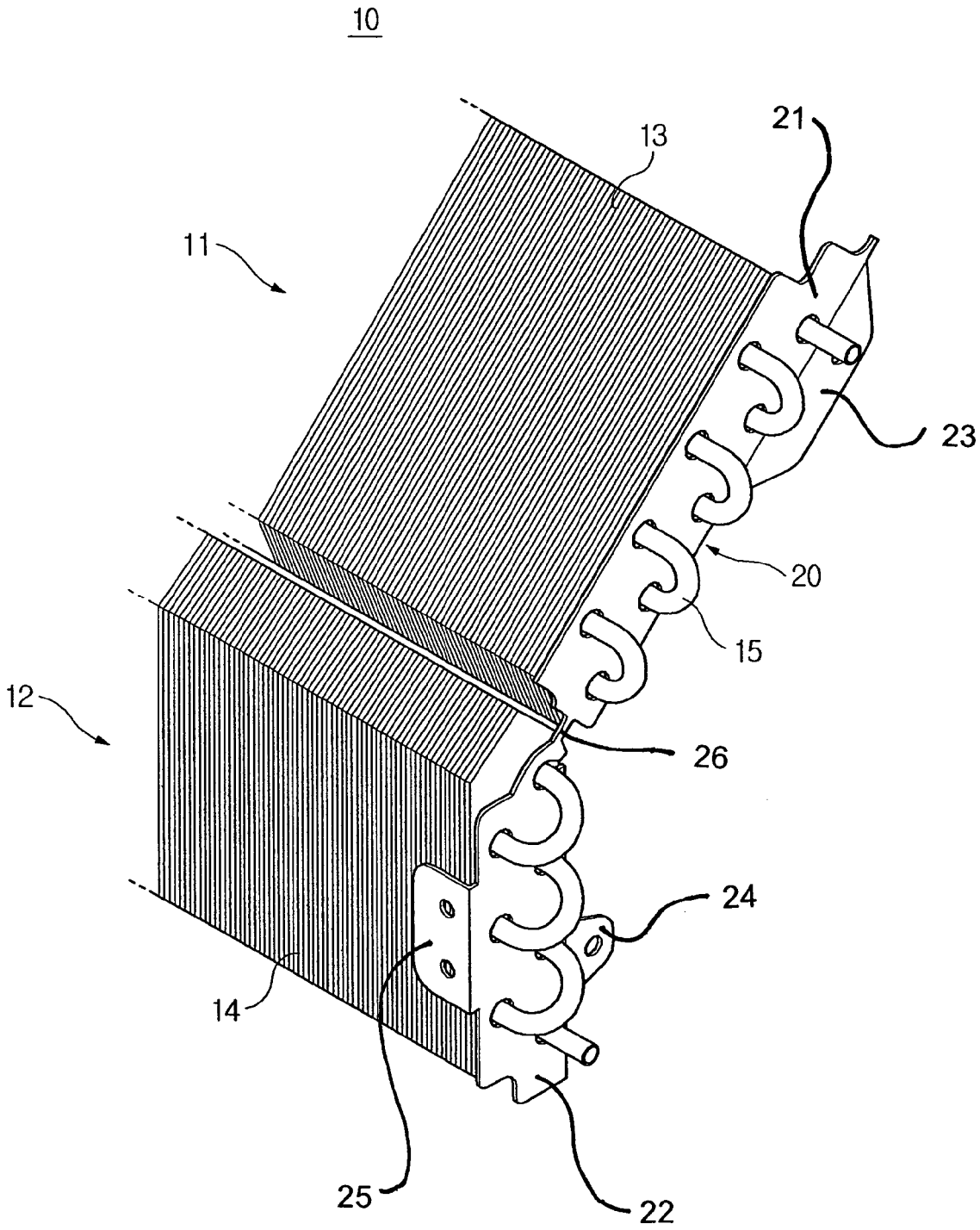
FIG. 1 is a perspective view of a heat exchanger, according to an exemplary embodiment of the present invention.

Reference will now be made in detail to illustrative, non-limiting embodiments of the present invention, examples of which are illustrated in the accompanying drawings, wherein like reference numerals refer to like elements throughout. The embodiment is described below in order to explain the present invention by referring to the figures.

Figure 2:
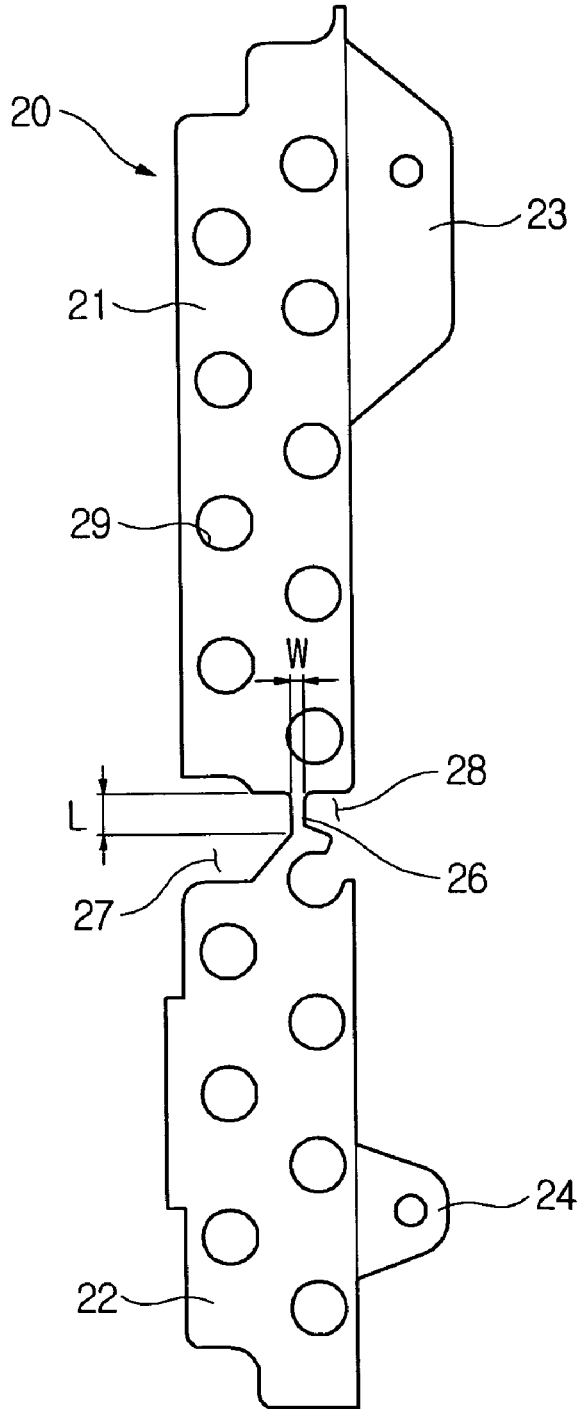
FIG. 2 is a front view of an end plate, prior to being bent, for the heat exchanger of FIG. 1.
Figure 3:
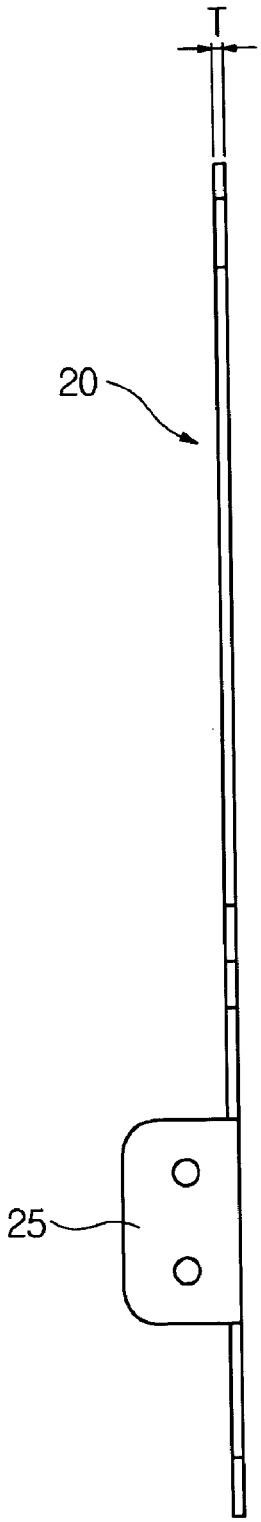
FIG. 3 is a side view of the end plate of FIG. 2.

FIG. 1 is a perspective view of a heat exchanger, according to an embodiment of the present invention. FIG. 2 is a front view of an end plate for the heat exchanger of FIG. 1. FIG. 3 is a side view of the end plate of FIG. 2.

As shown in FIG. 1, the heat exchanger 10 includes a first heat exchanging part 11 which is placed above a horizontal central line of the heat exchanger 10, and a second heat exchanging part 12 which is placed under the central line. A plurality of fins are arranged to provide a first fin array 13 of the first heat exchanging part 11. Similarly, a plurality of fins are arranged to provide a second fin array 14 of the second heat exchanging part 12. In this case, the first and second fin arrays 13 and 14 function to transfer heat. An end plate 20 is provided on a side of the first and second fin arrays 13 and 14 to connect the first and second fin arrays 13 and 14 to each other. The heat exchanger 10 also includes a refrigerant pipe 15 to pass through the first and second fin arrays 13 and 14 and the end plate 20. The refrigerant pipe 15 is bent several times, and provides a refrigerant path.

With reference to FIG. 2, the end plate 20 of the heat exchanger 10 includes a first body 21 provided on a side of the first heat exchanging part 11, a second body 22 provided on a side of the second heat exchanging part 12, and a connecting part 26 to connect the first and second bodies 21 and 22 to each other. Further, first and second recesses 27 and 28 are respectively provided on opposite sides of the connecting part 26 to allow the connecting part 26 to be easily bent. Each of the first and second bodies 21 and 22 is a longitudinal body with a length longer than a width, and has a plurality of holes 29 to allow the refrigerant pipe 15 to pass through the first and second bodies 21 and 22. A first bracket 23 is provided on a side of the first body 21 to mount the first body 21 to a predetermined portion of an indoor unit, and a second bracket 24 is provided on a side of the second body 22 to mount the second body 22 to a predetermined portion of the indoor unit. Further, a guide part 25 (see FIG. 3) is provided on a side of the second body 22 opposite to the second bracket 24. The guide part 25 is bent toward the second fin array 14 to guide a position of the end plate 20 relative to the second fin array 14 (see FIG. 1).

The connecting part 26 is formed so that a width thereof is concave, with the first and second recesses 27 and 28 being respectively provided on the opposite sides of the connecting part 26. In this case, the connecting part 26 is provided to be eccentric from a central axis of the end plate 20 toward a bent direction of the connecting part 26. A size of the second recess 28 provided in the bent direction of the connecting part 26 is smaller than the first recess 27 opposite to the second recess 28.

The connecting part 26 has a predetermined length L and a predetermined width W so that the connecting part 26 is easily bent. When a galvanized steel sheet (SGCC-M) having a thickness T of 0.8 mm is used, it is preferable, but not necessary, that the connecting part 26 have the width W of 2 mm and the length L of 4.85 mm.

Figure 4:
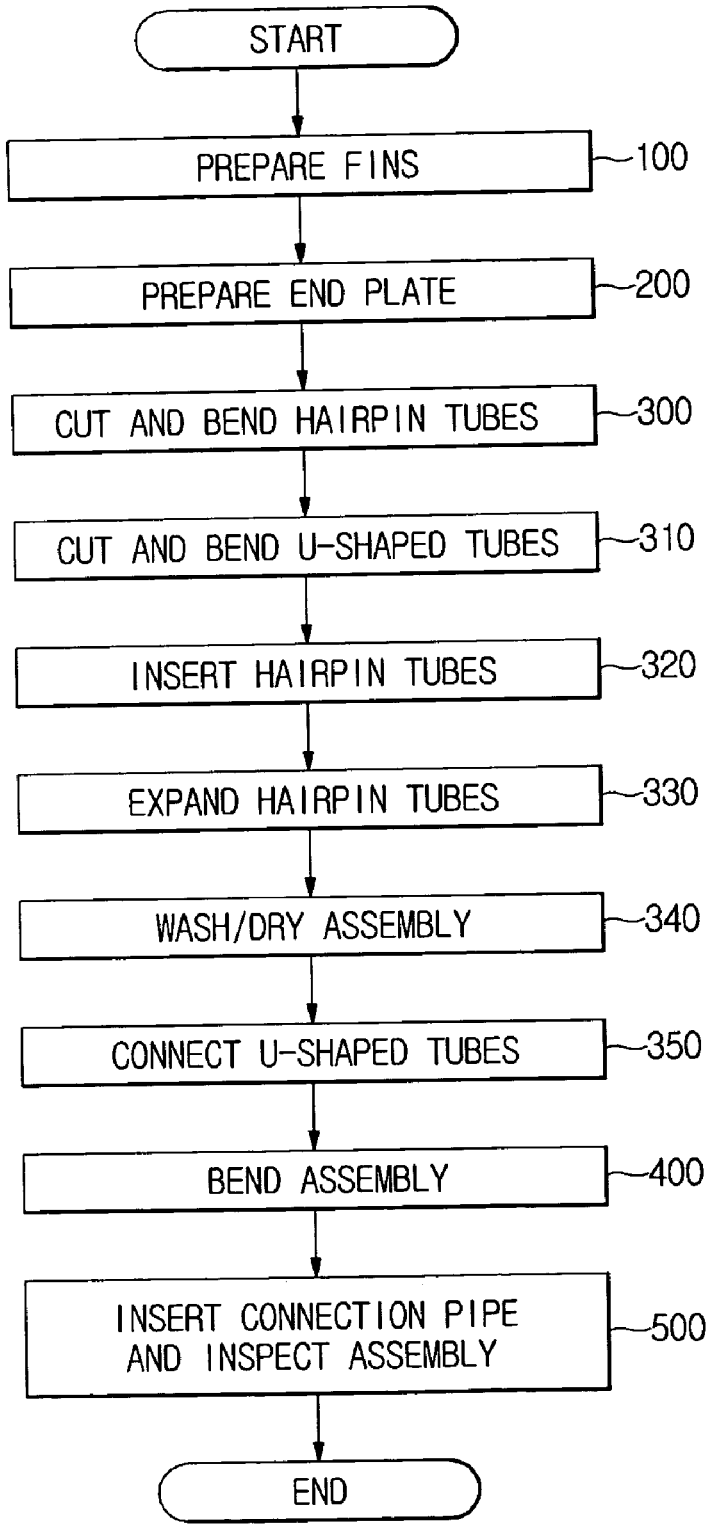
FIG. 4 is a flowchart to show a method of manufacturing the heat exchanger of FIG. 1.

As shown in FIG. 4, a method of manufacturing the heat exchanger 10 according to an embodiment of the present invention is as follows.

The method of manufacturing the heat exchanger 10 includes a fin preparing operation 100, an end plate preparing operation 200, assembling operations 300, 310, 320, 330, 340, and 350, an assembly bending operation 400, and a connection pipe inserting/inspecting operation 500. In the fin preparing operation 100, a plurality of fins are prepared through a blanking process, and are arranged to provide two or more parallel rows of fin arrays 13 and 14. In the end plate preparing operation 200, the end plate 20 is prepared through a blanking process, and is provided on a side of the fin arrays 13 and 14 to connect the fin arrays 13 and 14 to each other. In the assembling operations 300, 310, 320, 330, 340, and 350, the refrigerant pipe 15 is inserted into the fin arrays 13 and 14 and the end plate 20 to provide an assembly including the fin arrays 13 and 14, the end plate 20, and the refrigerant pipe 15. In the assembly bending operation 400, the assembly is bent at a predetermined angle around the connecting part 26 of the end plate 20. Further, in the connection pipe inserting/inspecting operation 500, a connection pipe is inserted into the bent assembly, and then the finished heat exchanger 10 is inspected.

In the fin preparing operation 100, a thin plate made of aluminum having high heat conductivity is placed on a die which has a same shape as the fins, and is stamped into the die by a punch, thus producing a fin. In this case, the fins of the first heat exchanging part 11 and the fins of the second heat exchanging part 12 are separately prepared through the blanking process.

In the end plate preparing operation 200, a plate made of the galvanized steel sheet (SGCC-M) is processed in a same manner as the fins, thus producing the end plate 20.

Of the assembling operations, hairpin tubes forming the refrigerant pipe 15 are manufactured in a hairpin tube-cutting/bending operation 300. The hairpin tubes are connected, at ends thereof, to each other, by U-shaped tubes. The U-shaped tubes are manufactured in a U-shaped tube cutting/bending operation 310. The hairpin tubes are inserted into the fins and the end plate 20 through the holes 29, in a hairpin tube-inserting operation 320. Thereafter, the hairpin tubes are expanded by a hairpin tube-expanding operation 330, to be mechanically fixed to the fins and the end plate 20. The assembly having the fins, the end plate 20, and the hairpin tubes is washed and dried in an assembly washing/drying operation 340. Further, the ends of the hairpin tubes are connected to each other by the U-shaped tubes in a U-shaped tube connecting operation 350, thus providing the refrigerant pipe 15 to define the refrigerant path.

In the hairpin tube cutting/bending operation 300, a copper tube is cut to provide tube pieces each having a predetermined length. Each of the tube pieces is bent at a central portion thereof to have a U-shape, thus providing the hairpin tubes. In this case, an outer diameter of each of the hairpin tubes must be smaller than the holes 29 formed on the fins and the end plate 20.

In the U-shaped tube cutting/bending operation 310, another copper tube is cut to provide tube pieces each having a predetermined length. Each of the tube pieces is bent at a central portion thereof to have a U-shape, thus manufacturing the U-shaped tubes.

In the hairpin tube inserting operation 320, the fins of the first and second heat exchanging parts 11 and 12 and the end plate 20 provided on a side of the heat exchanger 10 are arranged and are held in predetermined positions by a jig. Thereafter, the hairpin tubes are inserted from a side of the heat exchanger 10 opposite to the end plate 20 into the holes 29.

In the hairpin tube expanding operation 330, a mandrel is inserted into each of the hairpin tubes to mechanically expand the diameter of each of the hairpin tubes, so that the fins and the end plate 20 are firmly supported on outer surfaces of the hairpin tubes. The ends of each of the hairpin tubes are expanded to allow the U-shaped tube to be easily inserted into the ends of the associated hairpin tubes.

In the assembly washing/drying operation 340, the assembly is washed to remove impurities, such as oil stains, from the fins, the end plate 20, the hairpin tubes, etc. Subsequently, the washed assembly is placed in a heating furnace of about 150° C. to be dried.

In the U-shaped tube connecting operation 350, both ends of the U-shaped tube are inserted into the ends of the associated hairpin tubes, and are secured to the ends of the associated hairpin tubes through a welding process, thus providing the refrigerant pipe 15 to define the refrigerant path.

In the assembly bending operation 400, the heat exchanger 10 is bent to a desired shape which is suitable for being mounted to a predetermined position in the indoor unit of an air conditioner. In the heat exchanger 10 according to the embodiment, the fins of the first heat exchanging part 11 are separated from the fins of the second heat exchanging part 12, and the connecting part 26 of the end plate 20 provided on a side of the first and second fin arrays 13 and 14 has the width W and length L enough to be manually bent without using an additional cutting operation, and the first and second recesses 27 and 28 are respectively provided on the opposite sides of the connecting part 26, thus allowing the heat exchanger 10 to be easily bent.

In the connection pipe inserting/inspecting operation 500, the connection pipe is inserted into the heat exchanger 10 to connect the heat exchanger 10 to each of a compressor and a condenser, and then is secured to each of the compressor and the condenser through a welding process. Finally, welded parts of the refrigerant pipe 15 are monitored for refrigerant leakage.

As is apparent from the above description, the present invention provides an end plate for heat exchangers, which is constructed so that a connecting part to connect a first body to a second body of the end plate has a predetermined width and a predetermined length, and a recess is provided on the connecting part to allow the connecting part to be easily bent, thus allowing a heat exchanger to be easily bent without an additional cutting process, and thereby enhancing productivity of the heat exchanger.

Although an exemplary embodiment of the present invention has been shown and described, it would be appreciated by those skilled in the art that changes may be made in these embodiments without departing from the principles and spirit of the invention, the scope of which is defined in the claims and their equivalents.

What is claimed is:

1. A heat exchanger, comprising:

a plurality of fins arranged to provide two or more parallel rows of fin arrays;

an end plate provided on a side of the fin arrays to connect the fin arrays to each other, with a refrigerant pipe to pass through the fin arrays and the end plate, the end plate comprising:

a plurality of bodies, each of the plurality of bodies having a plurality of holes to allow the refrigerant pipe to pass through the plurality of bodies; and a connecting part to connect the plurality of bodies to each other, with a recess being provided on the connecting part to allow the connecting part to be easily bent, wherein the connecting part is provided so that a length of the connecting part is two to three times as large as a width of the connecting part, thus the connecting part is easily bent.

2. The heat exchanger according to claim 1, wherein the connecting part is provided so that the width of the connecting part is two to three times as large as a thickness of the connecting part.

3. The heat exchanger according to claim 2, wherein the connecting part is provided to be eccentric from a central axis of the end plate toward a bent direction of the connecting part.

4. The heat exchanger according to claim 3, wherein the recess comprises first and second recesses which are respectively provided on opposite sides of the connecting part, with a size of the first recess provided in the bent direction of the connecting part being smaller than the second recess opposite to the first recess.

5. The heat exchanger according to claim 4, wherein the end plate comprises a galvanized steel sheet having a thickness of 0.8 mm±0.08 mm, and the connecting part has the width of 2 mm±0.2 mm and the length of 4.85 mm±0.5 mm.

6. An end plate for heat exchangers, comprising:

a plurality of bodies, each of the plurality of bodies having a plurality of holes to allow a refrigerant pipe to pass through the plurality of bodies; and a connecting part to connect the plurality of bodies to each other, with a recess being provided on the connecting part to allow the connecting part to be easily bent.

wherein the connecting part is provided so that a length of the connecting part is two to three times as large as a width of the connecting part, thus the connecting part is easily bent.

7. The end plate for heat exchangers according to claim 6, wherein the connecting part is provided so that the width of the connecting part is two to three times as large as a thickness of the connecting part.

8. The end plate for heat exchangers according to claim 7, wherein the connecting part is provided to be eccentric from a central axis of the end plate toward a bent direction of the connecting part.

9. The end plate for heat exchangers according to claim 8, wherein the recess comprises first and second recesses which are respectively provided on opposite sides of the connecting part, with a size of the first recess provided in the bent direction of the connecting part being smaller than the second recess opposite to the first recess.

10. The end plate for heat exchangers according to claim 9, wherein the end plate comprises a galvanized steel sheet having a thickness of 0.8 mm±0.08 mm, and the connecting part has the width of 2 mm±0.2 mm and the length of 4.85 mm±0.5 mm.

11. A method of manufacturing a heat exchanger, comprising:

preparing a plurality of fins arranged to provide two or more parallel rows of fin arrays;

preparing an end plate provided on a side of the fin arrays to connect the fin arrays to each other, the end plate comprising:

a plurality of bodies, each of the plurality of bodies having a plurality of holes; and a connecting part to connect the plurality of bodies to each other, with a recess being provided on the connecting part to allow the connecting part to be easily bent, wherein the connecting part is provided so that a length of the connecting part is two to three times as large as a width of the connecting part, thus the connecting part is easily bent;

inserting a refrigerant pipe into the fin arrays and the end plate through the holes of the plurality of bodies to provide an assembly including the refrigerant pipe, the fin arrays, and the end plate; and bending the assembly, including the refrigerant pipe, the fin arrays, and the end plate, at a predetermined angle around the connecting part of the end plate.

* * * * *